United States Patent [19]

Paxton

[11] Patent Number: 4,509,231

[45] Date of Patent: Apr. 9, 1985

[54] DUAL-OPENING BAG CLOSURE

[76] Inventor: Jerre H. Paxton, 2720 S. 16th Ave., Yakima, Wash. 98903

[21] Appl. No.: 498,967

[22] Filed: May 27, 1983

[51] Int. Cl.[3] ..... B65D 77/10

[52] U.S. Cl. ..... 24/30.5 R; 24/30.5 S; 24/563; 53/138 A; 206/343

[58] Field of Search ..... 24/30.5 R, 30.5 S, 30.5 P, 24/30.5 T, 30.5 L, 30.5 W, 67.9, 543, 563; 206/343; 292/318, 321, 322; 53/138 A

[56] References Cited

U.S. PATENT DOCUMENTS

| | | | |
|---|---|---|---|
| 717,777 | 1/1903 | Smith | 24/563 |
| 1,644,948 | 10/1927 | Poirier | 24/563 |
| 2,133,068 | 10/1938 | Wiegman | 24/563 |
| 3,164,249 | 1/1965 | Paxton | 24/30.5 S |
| 3,164,250 | 1/1965 | Paxton | 24/30.5 S |
| 3,270,874 | 9/1966 | Hilton | 206/343 |
| 3,370,396 | 2/1968 | Paxton et al. | 53/138 A |
| 3,822,441 | 7/1974 | Paxton | 24/30.5 S |
| 4,026,413 | 5/1977 | Britt et al. | 24/30.5 S |
| 4,333,566 | 6/1982 | Holmes | 206/343 |
| 4,341,303 | 7/1982 | Britt | 206/343 |
| 4,361,935 | 12/1982 | Paxton | 24/30.5 R |

FOREIGN PATENT DOCUMENTS

| | | | |
|---|---|---|---|
| 1409426 | 10/1975 | United Kingdom | 206/343 |

*Primary Examiner*—Victor N. Sakran

*Attorney, Agent, or Firm*—Seed and Berry

[57] ABSTRACT

A strip of closures and individual closures having different configurations of bag neck-confining apertures entered through openings in opposite edges of the closures. The differing configurations of the bag neck-confining apertures can be different sizes and/or different shapes, and preferably are in the opposite sides of a strip of closures so that the differing bag neck-confining apertures can be exposed to oncoming bags merely by flipping the strip over 180 degrees.

5 Claims, 4 Drawing Figures

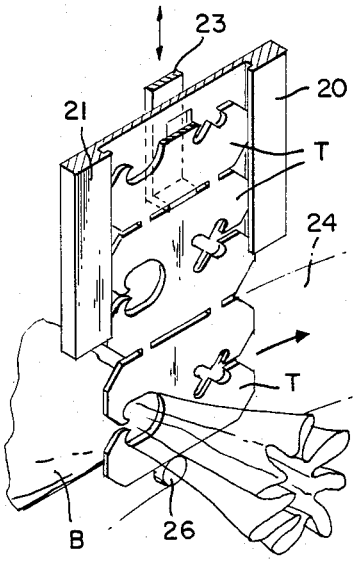
FIG. 1
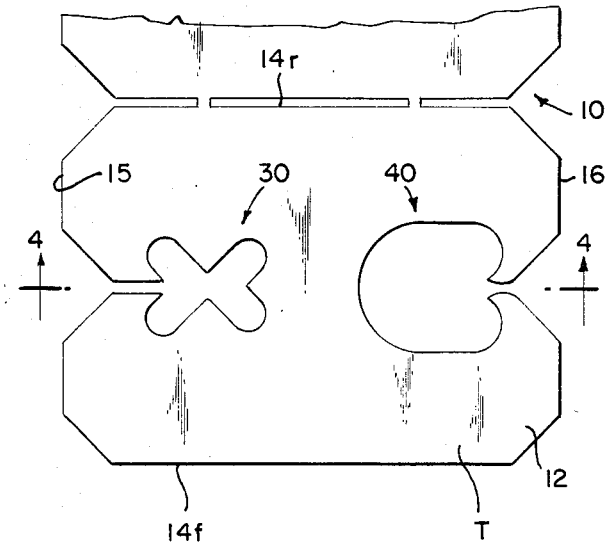
FIG. 2
FIG. 3
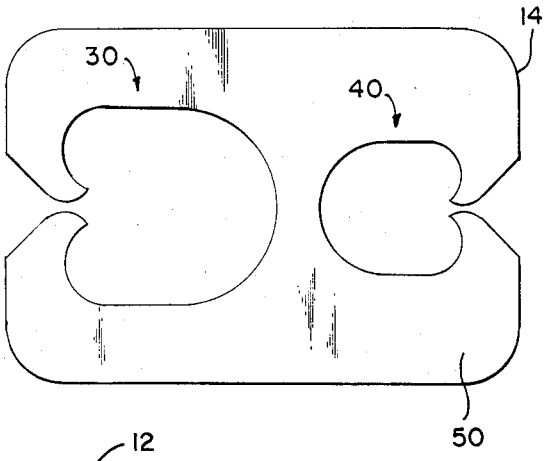
FIG. 4
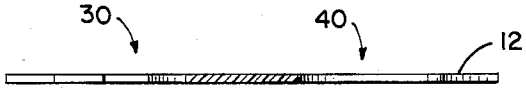

DUAL-OPENING BAG CLOSURE

TECHNICAL FIELD

This invention pertains to bag closures of the type having flat, thin bodies, with multiple openings in the edge of the bodies opening to bag neck-confining apertures.

BACKGROUND ART

Bag closures of the thin, flat configuration with a bag neck-confining aperture are known. A typical example is shown in U.S. Pat. No. 3,164,250. As described in this patent, these closures frequently, though not always, are assembled in strip form. The closures are then fed through a channel to expose the terminal closure to a bag neck to be closed. The bag is moved into the bag neck-confining aperture of the terminal closure through the opening in the edge and the terminal closure is then separated from the strip.

It is customary to stock in inventory closures and strips of closures having various sized bag neck-confining apertures in order to accommodate different sized bags and bags of different materials which require larger confining apertures, or simply bag neck-confining apertures which are generally of the same size but which may have different shaped apertures to accommodate different types of materials. For example, one bag neck-confining aperture may be smooth, as shown in U.S. Pat. No. 3,164,250, or the bag neck-confining aperture may have a special configuration, such as shown in U.S. Pat. No. 3,822,441, for handling special bag materials.

DISCLOSURE OF INVENTION

It is an object of this invention to provide a multiple-closure strip in which each of the closures is provided with two bag neck-confining apertures of different size or shape.

It is an object of this invention to provide a flat, thin, transversely stiff plastic bag closure in which at least two different bag neck-confining apertures are provided in opposite ends of the closure joining openings in the peripheral edges of such closure.

Basically, these objects are obtained by providing, in its broadest form, a flat, thin, transversely rigid bag closure having, in opposite peripheral edges, multiple openings to bag neck-confining apertures which differ in size, shape, or both, to accommodate different sized bags or bags of different material. In the preferred embodiment, these closures are joined in a frangible manner in strip form, with the strips being moved in strip-guiding members for movement lengthwise of the strip. Preferably, the openings will be in the opposite side edges and the apertures at opposite ends of the closures. These different openings and the different sized apertures can be easily exposed to the different bags merely by reversing the strip in the strip-guiding members.

As is readily apparent, a multiple bag neck aperture type of closure reduces the number of strips of bag closures necessary to be kept in inventory. A customer who handles two different size bags or two bags of different types therefore need only order a single type of strip or single type of bag closure and can handle the multiple types of bags. In addition, the strips of closures and the cartons containing the closures will weigh less and are less expensive to purchase, handle and ship than if two separate sets or strips of closures were necessary.

BRIEF DESCRIPTION OF THE DRAWINGS

FIG. 1 illustrates a schematic bag-closing machine for applying closures having multiple bag neck-closing openings in accordance with the teachings of the invention.

FIG. 2 is an embodiment of a strip of closures showing differing types of bag neck-confining apertures in opposite ends of each closure.

FIG. 3 is another embodiment of a closure having multiple bag neck-confining apertures of different types in a single closure.

FIG. 4 is a section taken along line 4—4 of FIG. 2.

BEST MODE FOR CARRYING OUT THE INVENTION

As is best shown in FIG. 2, a strip 10 of bag closures of the type shown in U.S. Pat. Nos. 3,164,250; 3,370,396; and 3,822,441 is shown. This type of closure has a thin, flat body 12 with a periphery or side edges 14. In the preferred embodiment, as shown in FIG. 2, the side edges have a forward edge **14*f* and rearward edge 14*r*, a lengthwise side edge (lengthwise of the strip) 15, and an opposite side edge 16**. The periphery does not have to be rectangular in shape; other configurations will also be contemplated.

As is disclosed in the earlier patents, these closures are joined in a frangible manner with the next adjacent closure so that the terminal closure T can be separated from the strip 10 by breaking the terminal closure from the strip when the neck of the bag B has been closed.

As is also well understood, these closures are fed in strip form through guiding members 20 and 21 by a feed finger or other similar mechanism 23. The bags B are carried on a conveyor 24, and the neck of the bag is pushed into the bag neck-closing opening of the closure by brushes or belts 26. A suitable structure for performing these functions is described in U.S. Pat. No. 3,370,396, the description of which is incorporated herein by reference hereto.

It is a unique feature of this invention that at least two bag neck-confining apertures 30 and 40 are provided in each closure. In the embodiment shown in FIGS. 1 and 2, the bag neck-confining apertures are in opposite ends and accessed by openings on opposite edges 15 and 16 of the closure. Thus, in this embodiment, the strip need only be flipped over in the guides 21 and 20 to expose the opposite bag neck-confining aperture. As is also shown in FIG. 2, bag neck-confining aperture 30 is of a different configuration than that of bag neck-confining aperture 40. The aperture 30 can be of the same size or a different size from aperture 40. The aperture 30 can be of a special configuration, such as shown in U.S. Pat. No. 3,822,441, for net bags, or can be smooth.

FIG. 3 illustrates an alternative embodiment in which the closure 50 is of a configuration having the differing bag neck-confining apertures 30 and 40 of the same shape.

While the preferred embodiments of the invention have been illustrated and described, it should be understood that variations will be apparent to one skilled in the art without departing from the principles herein. Accordingly, the invention is not to be limited to the specific embodiments illustrated in the drawings.

I claim:

1. In a multiple-closure strip of the type for closing the neck of a bag or the like wherein each of the closures includes a flat, thin, transversely stiff body having opposite ends terminating in longitudinal side edges in the direction of the length of the strip, frangible means connecting the closures in said strip so as to cause at least one of said opposite longitudinal side edges of the terminal closure in the strip adapted to be exposed for contact with a bag neck to be closed, each of said opposite longitudinal side edges having an opening terminating in a bag neck-receiving aperture, with the bag neck-receiving aperture at one end of the closure being different from the bag neck-receiving aperture at the opposite end, whereby bags of various sizes or materials can be closed, with said closure dependent upon which side edge is exposed to the bag.

2. The closure strip of claim 1, said apertures in each closure differing in size.

3. The closure strip of claim 1, said apertures in each closure differing in shape.

4. In the strip of claim 1, said opposite longitudinal side edges each including a guide surface for guiding the strip through a bag-closing apparatus, the guide surface of the side edge opposite the side edge facing a bag neck to be closed adapted to support the strip against movement as the bag neck is moved into the aperture.

5. In a machine for applying closures of a multiple-closure strip onto bags or like objects, comprising a multiple-closure strip having a plurality of closures, each having a flat, thin, transversely stiff body, with adjacent closures joined together in said strip along fore and aft edges and with each closure having first and second ends terminating in first and second opposite side edges lengthwise of the strip, means for guiding said strip to expose at least said first side edge of a terminal closure to a bag to be closed, means for advancing said strip to successively expose said terminal closure and a first side edge of said terminal closure to a bag to be closed, each said side edge having an opening joining a bag neck-confining aperture, the bag neck-confining aperture joining one side edge of a closure differing from the bag neck-confining aperture joining the opposite side edge of the same closure, wherein different sized or types of bags can be closed by said closures by reversing the strip in said guiding means so that the second side edge of the closure becomes exposed to the bag to be closed.

* * * * *